US006862423B2

(12) United States Patent
Kim et al.

(10) Patent No.: US 6,862,423 B2
(45) Date of Patent: Mar. 1, 2005

(54) FUSING AND FIXING UNIT OF IMAGE FORMING APPARATUS HAVING INFRARED HEAT SOURCE

(75) Inventors: Yong-geun Kim, Gyeonggi-do (KR); Cheol-young Han, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/341,494

(22) Filed: Jan. 14, 2003

(65) Prior Publication Data

US 2003/0190177 A1 Oct. 9, 2003

(30) Foreign Application Priority Data

Apr. 3, 2002 (KR) ..... 2002-18223

(51) Int. Cl.[7] ..... G03G 15/20

(52) U.S. Cl. ..... 399/328; 219/216; 399/330; 399/333; 399/336

(58) Field of Search ..... 399/328, 330, 399/333, 335, 336; 432/60; 219/216, 469–471

(56) References Cited

U.S. PATENT DOCUMENTS 5,403,995 A * 4/1995 Kishino et al. ..... 219/216
5,546,175 A * 8/1996 Uehara et al. ..... 399/328
5,974,295 A * 10/1999 De Niel et al. ..... 399/333
6,002,894 A * 12/1999 De Niel et al. ..... 399/333 X
6,049,692 A * 4/2000 Hwang ..... 399/333
6,490,429 B2 * 12/2002 Okayasu et al. ..... 399/328

FOREIGN PATENT DOCUMENTS

JP 55-113076 9/1980

* cited by examiner

*Primary Examiner*—William J. Royer
(74) *Attorney, Agent, or Firm*—Staas & Halsey LLP

(57) ABSTRACT

A fusing and fixing unit used with an image forming apparatus including a fusing roller and an infrared heat source. The fusing roller has a main member that has hollow portions therein and is made of an opaque material and an infrared absorbent layer that is formed on the inner surface of the main member. The infrared heat source is installed inside the fusing roller and generates radiant heat having an infrared wavelength.

21 Claims, 4 Drawing Sheets

FUSING AND FIXING UNIT OF IMAGE FORMING APPARATUS HAVING INFRARED HEAT SOURCE

CROSS-REFERENCE TO RELATED APPLICATIONS

This application claims the benefit of Korean Application No. 2002-18223, filed Apr. 3, 2002, in the Korean Intellectual Property Office, the disclosure of which is incorporated herein by reference.

BACKGROUND OF THE INVENTION

1. Field of the Invention

The present invention relates to a fusing and fixing unit of an image forming apparatus, and more particularly, to a fusing and fixing unit of an image forming apparatus which is improved so as to increase the temperature of a fusing roller within a fast time and reduce a warm-up period.

2. Description of the Related Art

An image forming apparatus, in particular, an electrophotographic image forming apparatus, generally forms a toner image on a paper on which an image will be printed, through a process of charging a photoreceptor with a predetermined potential, scanning light onto the photoreceptor, developing a latent electrostatic image into a toner image, and transferring the toner image. Since the toner image is put on the paper, the image forming apparatus applies heat and pressure to fuse and fix the toner image to the paper. Here, fusing and fixing refer to an operation of applying heat and pressure to the toner image which is formed on a print medium, e.g., the paper, so as to fuse the toner image with heat and fix the toner image to the paper with pressure.

To save energy and prevent the internal temperature of the image forming apparatus from increasing, the image forming apparatus manages the surface temperature of the fusing roller during a printing operation through several temperature stages, e.g., warm-up, stand-by, printing, and sleep (power save) fusing temperatures.

The warm-up period refers to a period from when power is first turned on or from a sleep (power save) mode to a stand-by temperature, and the surface temperature of the fusing roller during the warm-up period is the warm-up temperature.

The stand-by fusing temperature state refers to the lowest temperature, which can increase up to the printing fusing temperature so that the image forming apparatus supplies a printing paper and prints an image on the printing paper through an electrophotographic process at the maximum printing speed.

The printing fusing temperature state refers to a fusing temperature needed to fuse and fix the toner image to the paper so that the toner image stably sticks to the paper after the printing operation.

The sleep (power save) fusing temperature state refers to a period in which a fusing temperature is maintained at room temperature by intercepting power from being applied to a heat source to save power-related energy when the printing operation is not performed for a long period of time.

Accordingly, the warm-up period is important to the image forming apparatus.

A conventional fusing and fixing unit uses a halogen lamp as a heat source to heat the surface of the fusing roller to a temperature required to instantaneously fuse the toner image, passes the paper to which the toner image is formed between the fusing roller and a pressing roller, and fixes the fused toner image to the paper.

After the fusing roller is heated to the printing fusing temperature state by heat generated by the halogen lamp, which is installed in the center of the fusing roller, the toner image is fused and fixed to the paper when the paper passes between the fusing roller and the pressing roller.

The halogen lamp uses a radiant heating method by which the inner surface of the fusing roller, which is spaced apart (generally 5–20 mm) from the halogen lamp, is heated through an air gap (between the halogen lamp and the inner surface of the fusing roller). However, since the halogen lamp has poor heat radiation efficiency, it takes a considerable amount of time to heat the inner surface of the fusing roller. As known in the art, if the halogen lamp is used as a heat source, the warm-up period requires 30 seconds—1 minute in a single color image forming apparatus but 3–5 minutes in a multi-color image forming apparatus.

SUMMARY OF THE INVENTION

Accordingly, it is an aspect of the present invention to provide a fusing and fixing unit of an image forming apparatus which is improved so as to greatly shorten a warm-up period, compared to the related art of using a halogen lamp as a heat source.

Additional aspects and advantages of the invention will be set forth in part in the description which follows and, in part, will be obvious from the description, or may be learned by practice of the invention.

The foregoing and/or other aspects of the present invention are achieved by providing a fusing and fixing unit of an image forming apparatus including a fusing roller and an infrared heat source. The fusing roller has a main member that has hollow sections therein and is made of an opaque material and an infrared absorbent layer that is formed on the inner surface of the main member. The infrared heat source is installed inside the fusing roller and generates radiant heat having an infrared wavelength.

In an aspect of the invention, the main member is formed of a metallic material, e.g., an aluminum material.

In another aspect of the invention, the fusing and fixing unit further includes an elastic layer which is formed on the outer circumference of the main member.

In yet another aspect of the invention, the fusing and fixing unit further includes a release layer which is formed on the outer circumference of the main member or on the elastic layer.

In yet another aspect of the invention, the heat source radiates infrared radiation having a wavelength of about 0.76–5.6 $\mu$m.

In yet another aspect of the invention, the fusing roller has a diameter of 20 mm or more.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE INVENTION

Figure 1:
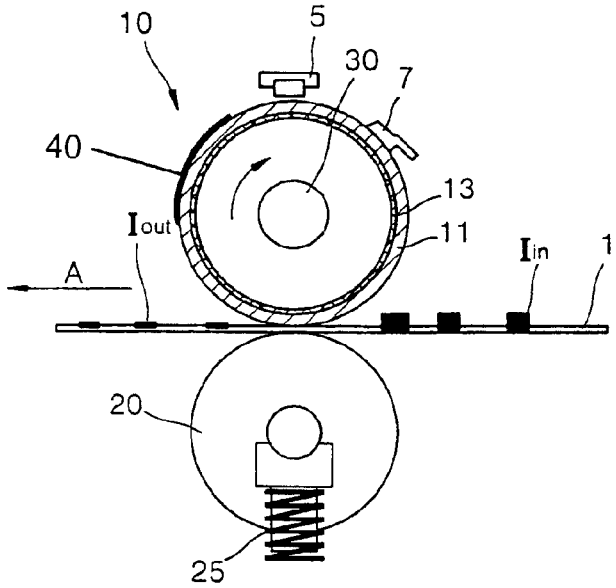
FIG. 1 is a schematic cross-sectional view of a fusing and fixing unit of an image forming apparatus according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

Referring to FIG. 1, an image forming apparatus according to an embodiment the present invention includes a fusing roller 10, a pressing roller 20, and an infrared heat source 30. The fusing roller 10 rotates in a direction A in which a paper 1 to which a toner image is formed is discharged. The pressing roller 20 is installed so as to face the fusing roller 10 and rotates while elastically biased toward the fusing roller 10, by an elastic compressing member, e.g., a compressing spring 25. The infrared heat source 30 heats the fusing roller 10 up to a printing fusing temperature state. A thermostat 5 is installed above the fusing roller 10. The thermostat 5 intercepts power from a power supply (not shown) that supplies power to the infrared heat source 30 when the surface temperature of the fusing roller 10 sharply increases so as to prevent the fusing roller 10 from being overheated. A thermistor 7, which senses the surface temperature of the fusing roller 10, is installed on the fusing roller 10. By using the thermistor 7, the surface temperature of the fusing roller 10 is controlled to maintain a temperature which allows the toner image to be fixed to the paper 1 during a printing operation. In FIG. 1, reference character Iin represents toner images which are transferred to and placed on the paper 1, and reference character Iout represents toner images which are fused and fixed to the paper 1.

In the embodiment of FIG. 1, the fusing roller 10 includes a main member 11 of a tube type, which has hollow portions therein and is made of an opaque material, and an infrared absorbent layer 13, which is formed on the inner surface of the main member 11. The main member 11 is formed of a metallic material, preferably, an aluminium material (aluminium or aluminium alloy). The infrared absorbent layer 13 is formed by coating the inner surface of the main member 11 with a material that absorbs infrared rays.

Figure 2:
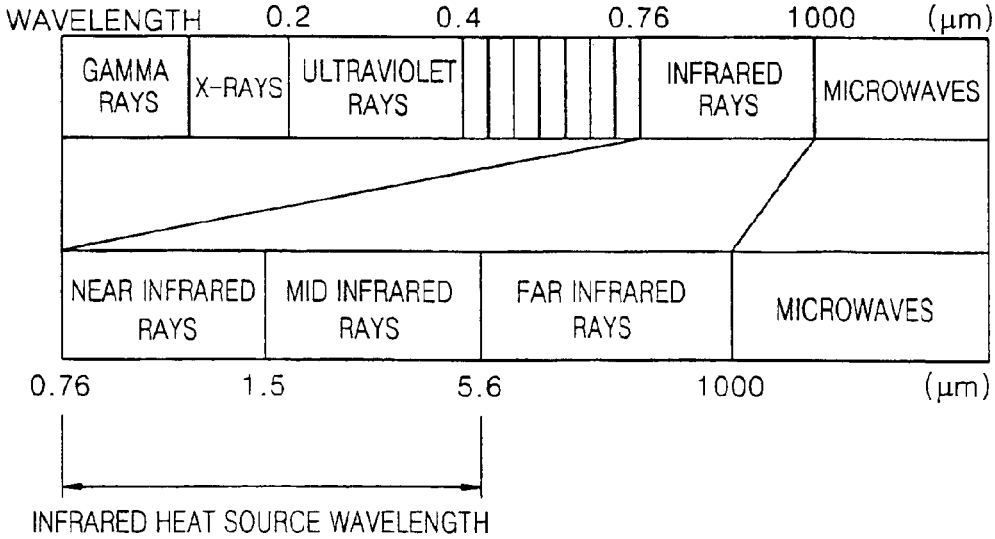
FIG. 2 illustrates the wavelength range of an infrared heat source of the fusing and fixing unit of the image forming apparatus according to the FIG. 1.

The infrared heat source 30 is installed at an inner space of the fusing roller 10. It is preferable that the infrared heat source 30 includes an infrared heat lamp or an infrared heater which radiates infrared radiation, preferably, infrared radiation with a wavelength of about 0.76–5.6 $\mu$m. As illustrated in FIG. 2, infrared radiation having a wavelength of about 0.76–5.6 $\mu$m ranges from near infrared radiation to mid infrared radiation.

The fusing and fixing unit according to the embodiment of FIG. 1, which includes the fusing roller 10 having the main member 11 and the infrared absorbent layer 13, uses silicone oil 40 that coats the surface of the fusing roller 10 and is suitable for a single color image forming apparatus using a toner that does not contain wax. The thickness of the silicone oil 40 is exaggerated for clarity. Furthermore, the silicone oil 40 generally coats the entire surface of the main member 11.

Figure 3:
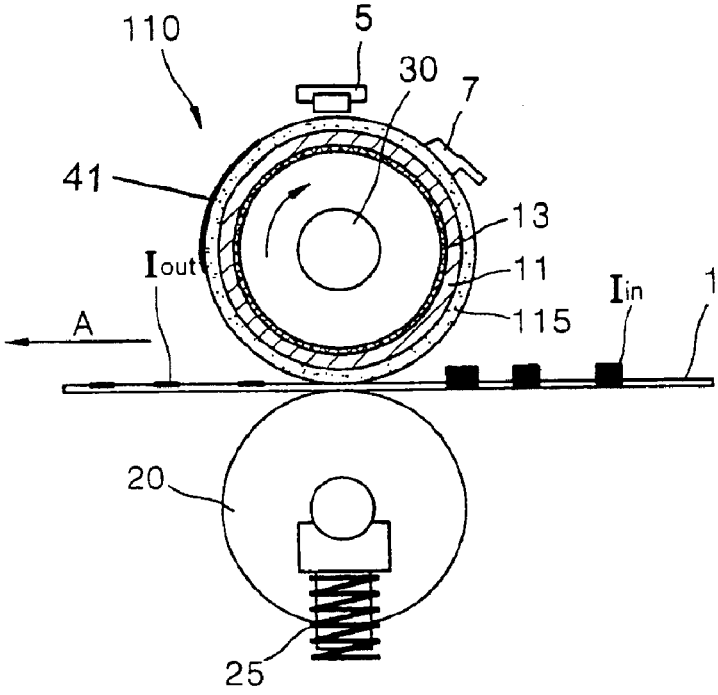
FIG. 3 is a schematic cross-sectional view of a fusing and fixing unit of an image forming apparatus according to another embodiment of the present invention.

FIG. 3 is a schematic cross-sectional view of a fusing and fixing unit used with an image forming apparatus according to another embodiment of the present invention. A fusing roller 110 is different from the fusing roller 10 according to the previous embodiment in that the fusing roller 110 further includes an elastic layer 115 that is formed on the outer circumference of the main member 11. The elastic layer 115 may be made of a rubber material.

The fusing and fixing unit according to this embodiment uses silicone oil 41 that coats the surface of the fusing roller 110 and is suitable for a multicolor image forming apparatus using a toner that does not contain wax. The thickness of the silicone oil 41 is exaggerated for clarity. Furthermore, the silicone oil 41 generally coats the entire surface of the main member 11.

Here, the fusing and fixing unit having the fusing roller 110, on which the elastic layer 115 is formed of a rubber material, is applied to the multicolor image forming apparatus for the following reason.

Figure 4:
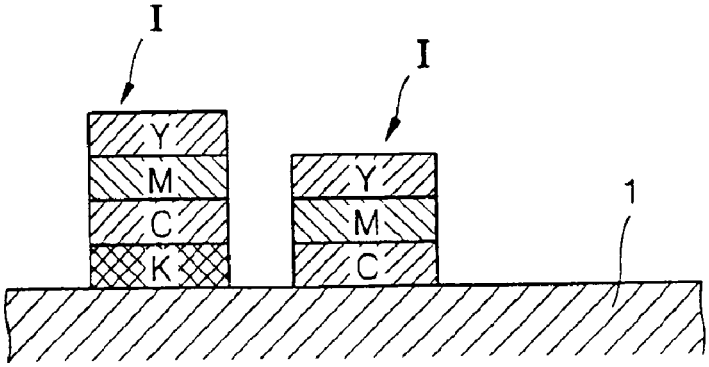
FIG. 4 is a schematic cross-sectional view of an example of color toner images formed on a piece of printing paper.
Figure 5:
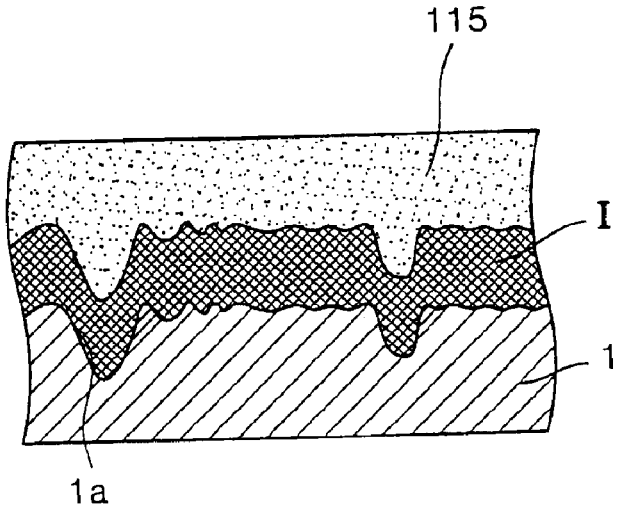
FIG. 5 is a schematic cross-sectional view of an elastic layer of a fusing roller according to the embodiments of the present invention, which is transformed so as to correspond to the uneven surface of a printing paper.

Referring to FIG. 4, multi-color toner images may be formed on a paper 1 using the multicolor image forming apparatus by stacking four colors, i.e., Yellow (Y), Magenta (M), Cyan (C), and Black (K), or stacking some of the four colors. The multi-color toner images I may be stacked on the paper 1 to be higher than single color toner images. Also, since the multi-color toner images each may have various colors, the color toner images may have different heights. Further, as illustrated in FIG. 5, a surface 1*a* of the paper 1 is uneven in view of the toner image having a very small size. Thus, the surface of the fusing roller 110 has to be transformed so as to correspond to the paper 1 having the uneven surface 1*a*. This transformation is necessary in order to properly fuse and fix the color toner images having different heights to the paper 1 when the paper 1, to which the color toner images are formed, passes between a pressing roller 20 that is elastically biased toward the fusing roller 110 by a compressing spring 25 and the fusing roller 110. In FIG. 5, reference numeral 115 represents an elastic layer of the fusing roller 110 which is transformed so as to correspond to the uneven surface 1*a* of the paper 1.

Accordingly, it is preferable that the fusing roller 110 on which the elastic layer 115 is formed is applied to the multicolor image forming apparatus. A single color image forming apparatus may include the fusing roller 110 on which the elastic layer 115 is formed.

Figure 6:
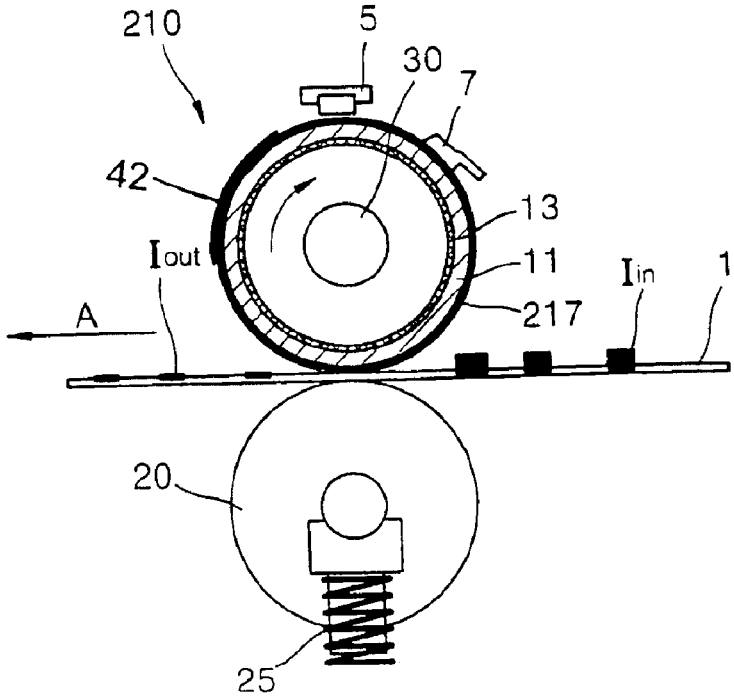
FIG. 6 is a schematic cross-sectional view of a fusing and fixing unit of an image forming apparatus according to yet another embodiment of the present invention.

FIG. 6 is a schematic cross-sectional view of a fusing and fixing unit used with an image forming apparatus according to another embodiment of the present invention. The fusing and fixing unit according to this embodiment is different from the fusing and fixing unit according to the embodiment of FIG. 1 in that a fusing roller 210 further includes a release layer 217 which is formed on the outer circumference of the main member 11. The release layer 217 helps toner images formed on a paper 1 from sticking to the fusing roller 210 when the toner images pass between the fusing roller 210 and a pressing roller 20. The release layer 217 may be formed of Teflon and serves as a protective layer that protects the fusing roller 210.

The fusing and fixing unit according to this embodiment does not coat the surface of the fusing roller 210 with silicone oil 42 and is suitable for a single color image forming apparatus using a toner that contains wax. The thickness of the silicone oil 42 is exaggerated for clarity. Furthermore, the silicone oil 42 generally coats the entire surface of the main member 11.

Figure 7:
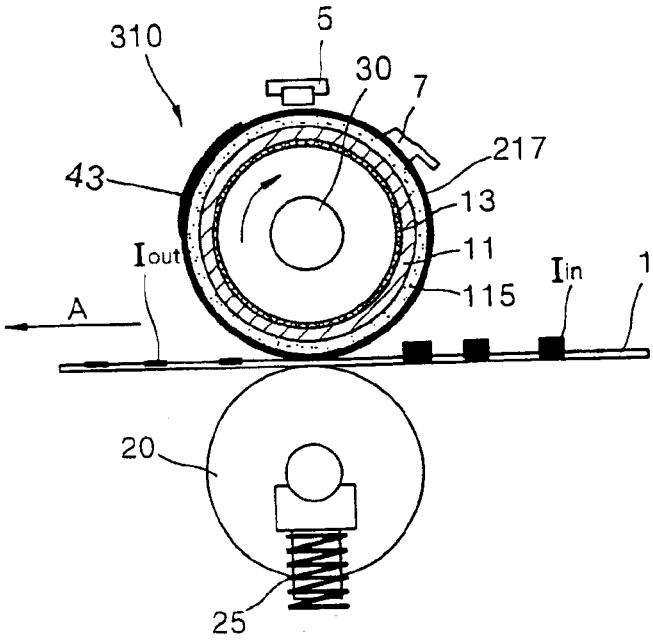
FIG. 7 is a schematic cross-sectional view of a fusing and fixing unit of an image forming apparatus according to yet another embodiment of the present invention.

FIG. 7 is a schematic cross-sectional view of a fusing and fixing unit used with an image forming apparatus according to another embodiment of the present invention. The fusing and fixing unit according to this embodiment is different from the fusing and fixing unit according to the embodiment of FIG. 1 in that a fusing roller 310 further includes an elastic layer 115, which is formed on the outer circumference of a main member 11 of a rubber material, and a release layer 217, which is formed on the elastic layer 115.

The fusing and fixing unit according to this embodiment does not coat the surface of the fusing roller 310 with silicone oil 43 and is suitable for a multi-color image forming apparatus using a toner that contains wax. The thickness of the silicone oil 43 is exaggerated for clarity. Furthermore, the silicone oil 43 generally coats the entire surface of the main member 11.

Though it has been described that one of the fusing and fixing units according to the above embodiments of the present invention is applied to an image forming apparatus depending on whether the image forming apparatus coats the surface of the fusing roller with silicone oil, whether the, toner contains wax, and whether the image forming apparatus is a single color image forming apparatus or a multicolor image forming apparatus, it is not restricted to the embodiments described. In other words, any one of the fusing and fixing units according to the above embodiments of the present invention may be applied to the image forming apparatus regardless of whether the image forming apparatus coats the surface of the fusing roller with silicone oil, whether toner contains wax, and whether the image forming apparatus is a single color image forming apparatus or a multicolor image forming apparatus.

It is preferable that the fusing rollers 10, 110, 210, and 310 according to the above embodiments of the present invention each has a large diameter of 20 mm or more, preferably, a large diameter of about 40 mm. If a fusing roller has a small diameter, since the width of a nip (not shown) is narrow, because the time required to transmit heat of the surface of the fusing roller to toner images on a paper is short, it is not efficient in fusing the toner images. Therefore, it is preferable that the width of the nip is as wide as possible. To increase the width of the nip, the fusing rollers 10, 110, 210, and 310 preferably have a diameter of 20 mm or more, and more preferably, a diameter of about 40 mm.

Since the fusing rollers 10, 110, 210, and 310 according to the above embodiments of the present invention are formed of an opaque material that is strong and easy to manufacture, e.g., a metallic material, the fusing rollers 10, 110, 210, and 310 can be manufactured at a low cost to have a large diameter of about 40 mm. The fusing rollers 10, 110, 210, and 310 may be formed of transparent glass. In this case, preferably, the fusing rollers 10, 110, 210, and 310 may be formed of a quartz tube considering uniformity of surface of the fusing and fixing roller. However, it costs too much to manufacture a quartz tube having a diameter of about 40 mm, and the hardness of the quartz tube is unreliable. Thus, as described previously, it is preferable that the fusing rollers 10, 110, 210, and 310 used in the fusing and fixing unit used with the image forming apparatus according to the embodiments of the present invention are formed of an opaque metal so as to be strong, low-priced, and have large diameters.

The above-described fusing and fixing units according to the above embodiments of the present invention have the infrared heat source 30, which has a high efficiency of radiating heat and radiates the heat radiation (near or mid infrared radiation having a wavelength of about 0.76–5.6 $\mu$m) as a heat source in the fusing rollers 10, 110, 210, and 310. The fusing and fixing units according to the above embodiments of the present invention use a method of radiating infrared heat in which the infrared heat source 30 hardly heats air and radiates a wavelength of the infrared heat only onto the inner surfaces of the fusing rollers 10, 110, 210, and 310.

Figure 8:
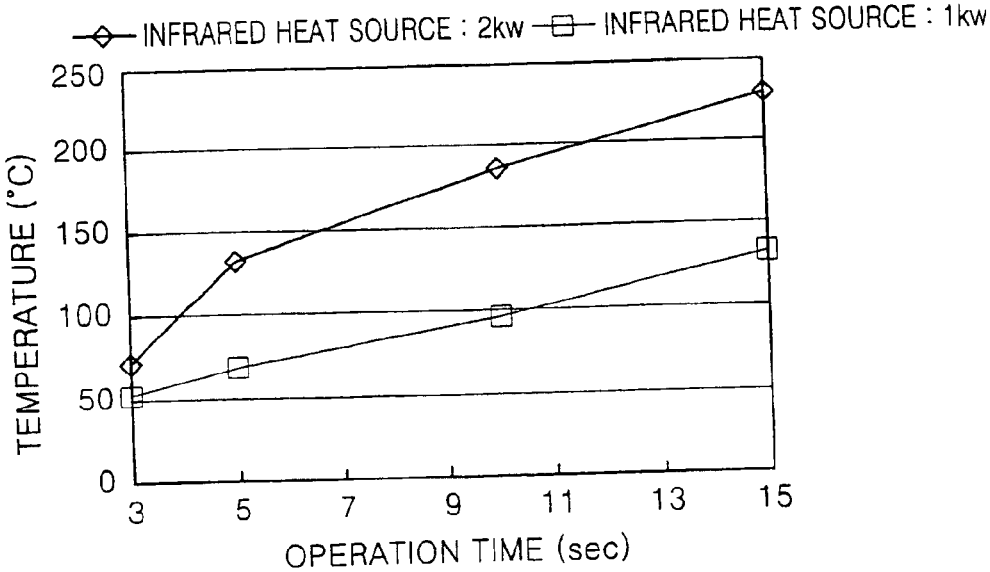
FIG. 8 is a graph illustrating changes in the temperature over time at the position being 50 mm from an infrared lamp used as a heat source in the fusing and fixing units according to the embodiments of the present invention.

Accordingly, as seen in the graph of FIG. 8, only the inner surfaces of the fusing rollers 10, 110, 210, and 310 are rapidly heated so that the fusing rollers 10, 110, 210, and 310, particularly, their surfaces, reach up to the printing fusing temperature state within a short time. Thus, the warm-up period can be greatly reduced. However, a conventional fusing and fixing unit uses a method of transmitting convective heat by which a halogen lamp heats and transmits heat through air between the halogen lamp and the inner surface of the fusing roller. Thus, the conventional fusing and fixing unit suffers from a large amount of heat loss and has a low heating speed.

FIG. 8 is a graph showing changes in the temperature over time at the position being 50 mm from an infrared lamp used as a heat source in the fusing and fixing units according to the above embodiments of the present invention. As shown in FIG. 8, when 10 seconds have elapsed after a 2 kW infrared lamp is operated, the temperature at the position, which is 50 mm apart from the infrared lamp, is about 185° C. If a halogen lamp is used under the same conditions, it takes several minutes to increase the temperature of the fusing roller to about 185° C.

If the fusing rollers 10, 110, 210, and 3101 each having a diameter of 40 mm, are used in the fusing and fixing units according to the above embodiments of the present invention, the distance from the infrared heat source 30 to the inner surfaces of the fusing rollers 10, 110, 210, and 310 is less than 20 mm. Thus, the temperature of the inner surfaces of the fusing rollers 10, 110, 210, and 310 can be increased to about 185° C. within several seconds.

As described above, since an image forming apparatus according to the present invention uses an infrared heat source 30 having a high efficiency of radiating heat as a heat source, a warm-up period can be greatly reduced, compared to a conventional halogen lamp used as a heat source. Also, since a main member 11 of the fusing roller 10, 110, 210, and 310 is formed of an opaque material, in particular, a metallic material, the image forming apparatus can be strong, low-priced, and have a large diameter.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing and fixing unit used with an image forming apparatus comprising:

a fusing roller which has a main member that has hollow portions therein and is made of an opaque material and an infrared absorbent layer that is formed on the inner surface of the main member; and an infrared heat source which is installed inside the fusing roller and generates radiant heat having an infrared wavelength of less than 3 $\mu$m.

2. The fusing and fixing unit of claim 1, wherein the main member is formed of a metallic material.

3. The fusing and fixing unit of claim 2, wherein the main member is formed of an aluminum material.

4. The fusing and fixing unit of claim 1, further comprising an elastic layer which is formed on the outer circumference of the main member.

5. The fusing and fixing unit of claim 4, wherein the elastic layer is a rubber material.

6. The fusing and fixing unit of claim 4, wherein the infrared radiation has a wavelength of greater than 5.6 $\mu$m.

7. The fusing and fixing unit of claim 4, further comprising a release layer which is formed on the elastic layer.

8. The fusing and fixing unit of claim 7, wherein the infrared radiation has a wavelength of greater than 5.6 $\mu$m.

9. The fusing and fixing unit of claim 1, further comprising a release layer which is formed on the outer circumference of the main member.

10. The fusing and fixing unit of claim 9, wherein the infrared radiation has a wavelength of greater than 5.6 $\mu$m.

11. The fusing and fixing unit of claim 1, wherein the fusing roller has a diameter of 20 mm or more.

12. The fusing and fixing unit of claim 1, wherein the fusing roller fuses multicolor images using a toner that does not contain wax.

13. The fusing and fixing unit of claim 12, further comprising a silicone oil to coat the surface of the fusing roller.

14. The fusing and fixing unit of claim 1, wherein the image forming apparatus is a multi-color image forming apparatus.

15. The fusing and fixing unit of claim 1, wherein the fusing roller has a main member that is made of an opaque material.

16. The fusing and fixing unit of claim 1, wherein the radiant heat mainly heats the fusing roller as compared to heating air between the fusing roller and the infrared heat source.

17. A fusing and fixing unit used with an image forming apparatus comprising:

a fusing roller which has a main member that has hollow portions therein and is made of an opaque material and an infrared absorbent layer that is formed on the inner surface of the main member; and an infrared heat source which is installed inside the fusing roller and generates radiant heat having an infrared wavelength of less than 3 $\mu$m to heat the fusing roller.

18. The fusing and fixing unit of claim 17, further comprising a silicone oil to coat the surface of the fusing roller and is suitable for using with a toner that does not contain wax.

19. The fusing and fixing unit of claim 17, wherein the main member is formed of a metallic material.

20. The fusing and fixing unit of claim 17, wherein the metallic material is aluminum or aluminum alloy.

21. The fusing and fixing unit of claim 17, wherein the image forming apparatus is a single color image forming apparatus.

* * * * *